US008167400B2

(12) United States Patent
Iriguchi

(10) Patent No.: US 8,167,400 B2
(45) Date of Patent: May 1, 2012

(54) DROPLET EJECTING DEVICE CAPABLE OF RECOVERING EJECTION PERFORMANCE EFFICIENTLY

(75) Inventor: Akira Iriguchi, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 604 days.

(21) Appl. No.: 12/362,150

(22) Filed: Jan. 29, 2009

(65) Prior Publication Data

US 2009/0195582 A1 Aug. 6, 2009

(30) Foreign Application Priority Data

Jan. 31, 2008 (JP) ..... 2008-021640

(51) Int. Cl.
*B41J 2/165* (2006.01)

(52) U.S. Cl. ..... 347/27; 347/5; 347/19; 347/20; 347/22; 347/23

(58) Field of Classification Search ..... 347/27
See application file for complete search history.

(56) References Cited

U.S. PATENT DOCUMENTS

| | | | | |
|---|---|---|---|---|
| 7,294,952 | B2 | 11/2007 | Ito | |
| 7,455,386 | B2 | 11/2008 | Ito | |
| 2006/0187257 | A1 | 8/2006 | Ito | |
| 2007/0139487 | A1* | 6/2007 | Sekiguchi | 347/70 |

FOREIGN PATENT DOCUMENTS

| | | | |
|---|---|---|---|
| JP | 2005-322850 | A | 11/2005 |
| JP | 2006-231661 | A | 9/2006 |
| JP | 2006-272754 | A | 10/2006 |

* cited by examiner

*Primary Examiner* — Ryan Lepisto
(74) *Attorney, Agent, or Firm* — Baker Botts L.L.P.

(57) ABSTRACT

A droplet ejecting head is formed with at least one nozzle and is configured to eject a liquid droplet through the at least one nozzle in a nozzle axis direction. A carriage supports the droplet ejecting head. A guide member extends in a predetermined direction and is configured to guide the carriage so that the carriage is movable in the predetermined direction. A moving section moves the carriage along the guide member. The droplet ejecting head is configured to eject a liquid droplet through the at least one nozzle onto an ejection object while the moving section moves the carriage. A vibration generating section vibrates the droplet ejecting head in such a manner that vibration of liquid held in the at least one nozzle includes a component in the nozzle axis direction.

19 Claims, 10 Drawing Sheets

DROPLET EJECTING DEVICE CAPABLE OF RECOVERING EJECTION PERFORMANCE EFFICIENTLY

CROSS REFERENCE TO RELATED APPLICATIONS

This application claims priority from Japanese Patent Application No. 2008-021640 filed Jan. 31, 2008. The entire content of the priority application is incorporated herein by reference.

TECHNICAL FIELD

The invention relates to a droplet ejecting device that ejects liquid droplets.

BACKGROUND

Generally, in an inkjet-type recording device serving as a droplet ejecting device, a droplet ejecting head having nozzles is supported by a carriage. The carriage is moved in a predetermined direction (hereinafter referred to as "main scanning direction"), while ink droplets are ejected from the nozzles of the droplet ejecting head. Each time the movement in the main scanning direction ends, a recording medium (a sheet of paper or the like) serving as an ejection object is moved by a predetermined amount in a sub-scanning direction perpendicular to the main scanning direction, thereby performing a recording operation.

Although ink is held in the nozzles of the droplet ejecting head in preparation for ink ejection, ink is exposed to air at the openings of the nozzles. Hence, if the time period between the previous ejection and the next ejection becomes long, ink at the nozzle openings dries and the viscosity increases gradually. Accordingly, if the next ejection is performed in this state, an ink droplet is ejected in a wrong direction deviated from the normal direction and, in a worse case, nozzles are clogged, which deteriorates the recording performance.

In order to prevent drying of ink at the nozzles, an inkjet recording device disclosed in U.S. Patent Application Publication No. 2006/0187257 A1 (corresponding to Japanese Patent Application Publication No. 2006-231661) moves a carriage supporting an inkjet head to a flushing position outside a recording region periodically or forcibly, prior to the start of a recording operation or during a recording operation. Then, inkjet recording device performs preliminary ejection (flushing ejection) of ejecting ink droplets from all the nozzles toward an ink receiving section.

On the other hand, Japanese Patent Application Publication No. 2006-272754 discloses an inkjet recording device in which an inkjet head is driven to apply small pressure to ink in such a manner that ink is not ejected from nozzles, thereby generating micro-vibration in ink to prevent drying of ink. When small pressure is applied to ink, a meniscus in each nozzle swells and then returns, thereby generating vibration. Thus, ink in the nozzles is stirred and drying of ink can be prevented.

SUMMARY

With the inkjet recording device disclosed in U.S. Patent Application Publication No. 2006/0187257 A1 (Japanese Patent Application Publication No. 2006-231661), ink droplets are ejected from the nozzles for flushing regardless of recording operations in order to recover the ejection performance. Thus, ink is consumed wastefully for a purpose other than recording. In addition, because the inkjet head needs to be driven for preliminary ejection (flushing ejection), the frequency of driving the inkjet head increases. Because this causes heating of the inkjet head as well as an increase in power consumption, heat of the inkjet head raises the temperature of ink within the inkjet head and thus the viscosity of ink decreases. This leads to a problem of instability of ejection characteristics.

With the inkjet recording device disclosed in Japanese Patent Application Publication No. 2006-272754, an meniscus formed in each nozzle is vibrated for recovering the ejection performance, but ink droplets are not ejected. Accordingly, wasteful consumption of ink can be avoided. However, the inkjet head needs to be driven to apply micro-vibration to the meniscus formed in each nozzle. Hence, this technology cannot overcome the problems of increased power consumption of the inkjet head and heating of the inkjet head.

In view of the foregoing, it is an object of the invention to provide a droplet ejecting device capable of recovering ejection performance efficiently.

In order to attain the above and other objects, the invention provides a droplet ejecting device. The droplet ejecting device includes a droplet ejecting head, a carriage, a guide member, a moving section, and a vibration generating section. The droplet ejecting head is formed with at least one nozzle and is configured to eject a liquid droplet through the at least one nozzle in a nozzle axis direction. The carriage supports the droplet ejecting head. The guide member extends in a predetermined direction and is configured to guide the carriage so that the carriage is movable in the predetermined direction. The moving section moves the carriage along the guide member. The droplet ejecting head is configured to eject a liquid droplet through the at least one nozzle onto an ejection object while the moving section moves the carriage. The vibration generating section vibrates the droplet ejecting head in such a manner that vibration of liquid held in the at least one nozzle includes a component in the nozzle axis direction.

BRIEF DESCRIPTION OF THE DRAWINGS

Embodiments in accordance with the invention will be described in detail with reference to the following figures wherein.

DETAILED DESCRIPTION

Figure 1:
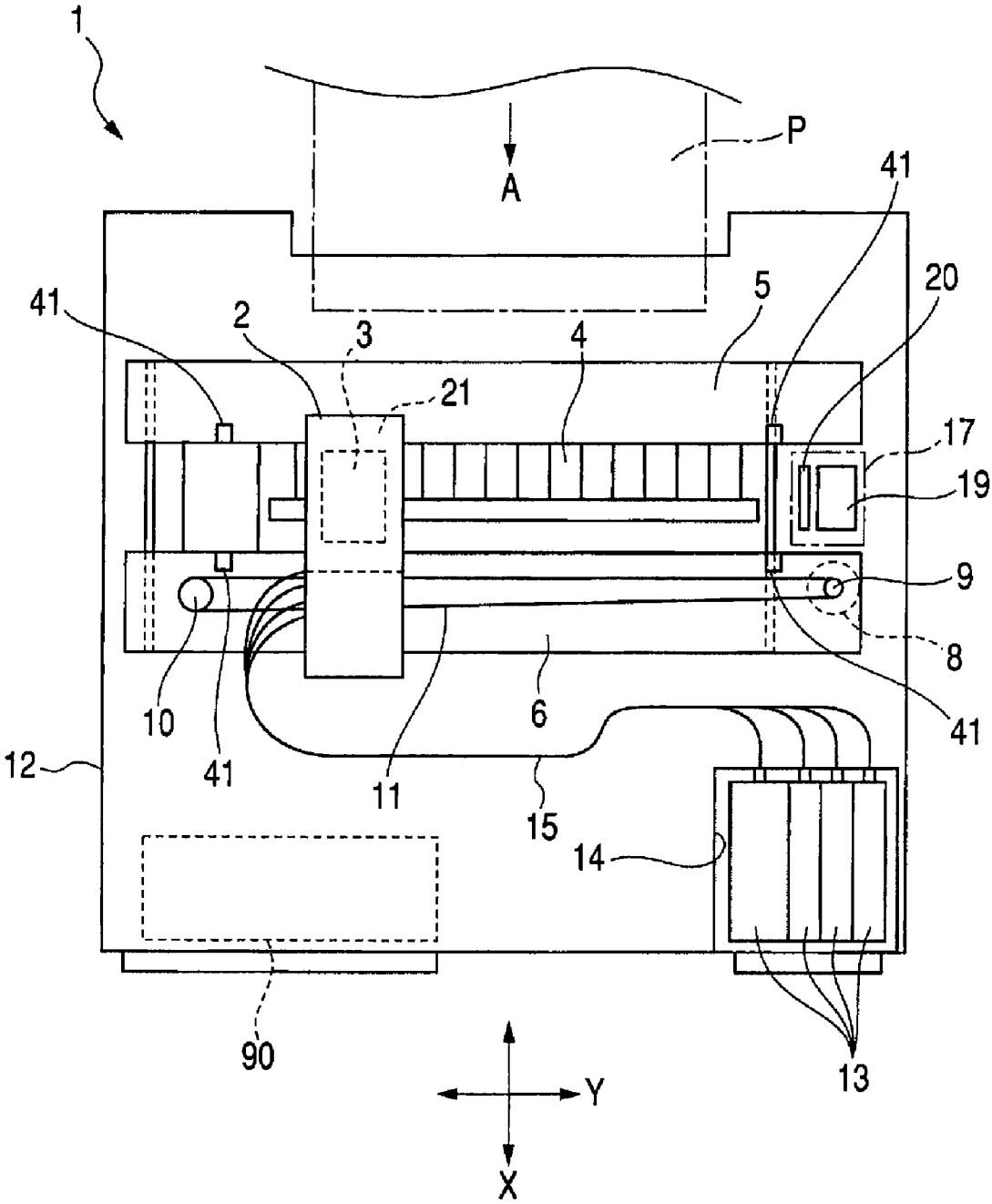
FIG. 1 is a schematic plan view of a recording device serving as a droplet ejecting device according to a first embodiment of the invention.

A droplet ejecting device according to a first embodiment of the invention will be described while referring to FIGS. 1 through 4C. FIG. 1 is a schematic plan view of a recording device 1 serving as the droplet ejecting device according to the first embodiment. The recording device 1 can be applied to a single-function printing apparatus, or to a printing section (recording section) of a multifunction apparatus having a plurality of functions such as a facsimile function and a copier function.

In the following description, the expressions "front", "rear", "upper", "lower", "right", and "left" are used to define the various parts when the recording device 1 is disposed in an orientation in which it is intended to be used.

As shown in FIG. 1, the recording device 1 includes a carriage 2, a recording head 3 mounted on the carriage 2 and serving as a droplet ejecting head, and a platen 4 provided in confrontation with the lower surface of the recording head 3. The recording head 3 is formed with nozzles 7 (see FIG. 3) that face recording paper P (ejection object) placed on the platen 4. Note that, in the following description, the side of the recording head 3 formed with the nozzles 7 is referred to as the lower side, and the opposite side is referred to as the upper side.

A first guide member 5 and a second guide member 6 (guide sections) are provided on a main frame 12. The carriage 2 is supported so that the carriage 2 is movable reciprocatingly along the first guide member 5 and the second guide member 6 in a direction parallel with the recording paper on the platen 4. The direction in which the carriage 2 moves reciprocatingly is referred to as the main scanning direction (Y-axis direction, a predetermined direction). Further, the direction perpendicular to the main scanning direction is referred to as the sub-scanning direction (X-axis direction). A moving section for moving the carriage 2 in the main scanning direction includes a carriage motor 8, a drive pulley 9 connected to the carriage motor 8, a follow pulley 10, and a timing belt 11 looped around the drive pulley 9 and the follow pulley 10. On the other hand, the recording paper P is conveyed in the sub-scanning direction (X-axis direction) by a roller mechanism (not shown) well-known in the art. More specifically, the recording paper P is inserted under the carriage 2 in a direction A (one-way direction along the X-axis direction), and is conveyed in the direction A to be discharged.

That is, as well-known in the art, the recording head 3 ejects ink droplets onto the recording paper P from the nozzles 7, while moving in the main-scanning direction (Y-axis direction). Each time the main scan ends, the recording paper P is conveyed in the sub-scanning direction (X-axis direction) by a predetermined distance.

Each of the first guide member 5 and the second guide member 6 (guide sections) is a plate-shaped member elongated in the Y-axis direction. A head holder 21 of the carriage 2 to be described later is mounted in such a manner that the head holder 21 straddles the upper surfaces of both the first guide member 5 and the second guide member 6. When the carriage 2 is scanningly moved in the Y-axis direction, carriage protruding members 26 (see FIG. 2) of the head holder 21 slide on the upper surfaces of both the first guide member 5 and the second guide member 6.

As shown in FIG. 1, a cartridge accommodating section 14 is provided within the main frame 12. The cartridge accommodating section 14 accommodates replaceable ink cartridges 13 in the number corresponding to the number of ink colors (four ink cartridges for black ink, cyan ink, magenta ink, and yellow ink in this example). Ink in each ink cartridge 13 is supplied individually to the recording head 3 of the carriage 2 via flexible ink supply tubes 15 (resin tubes in this example).

Figure 4A:
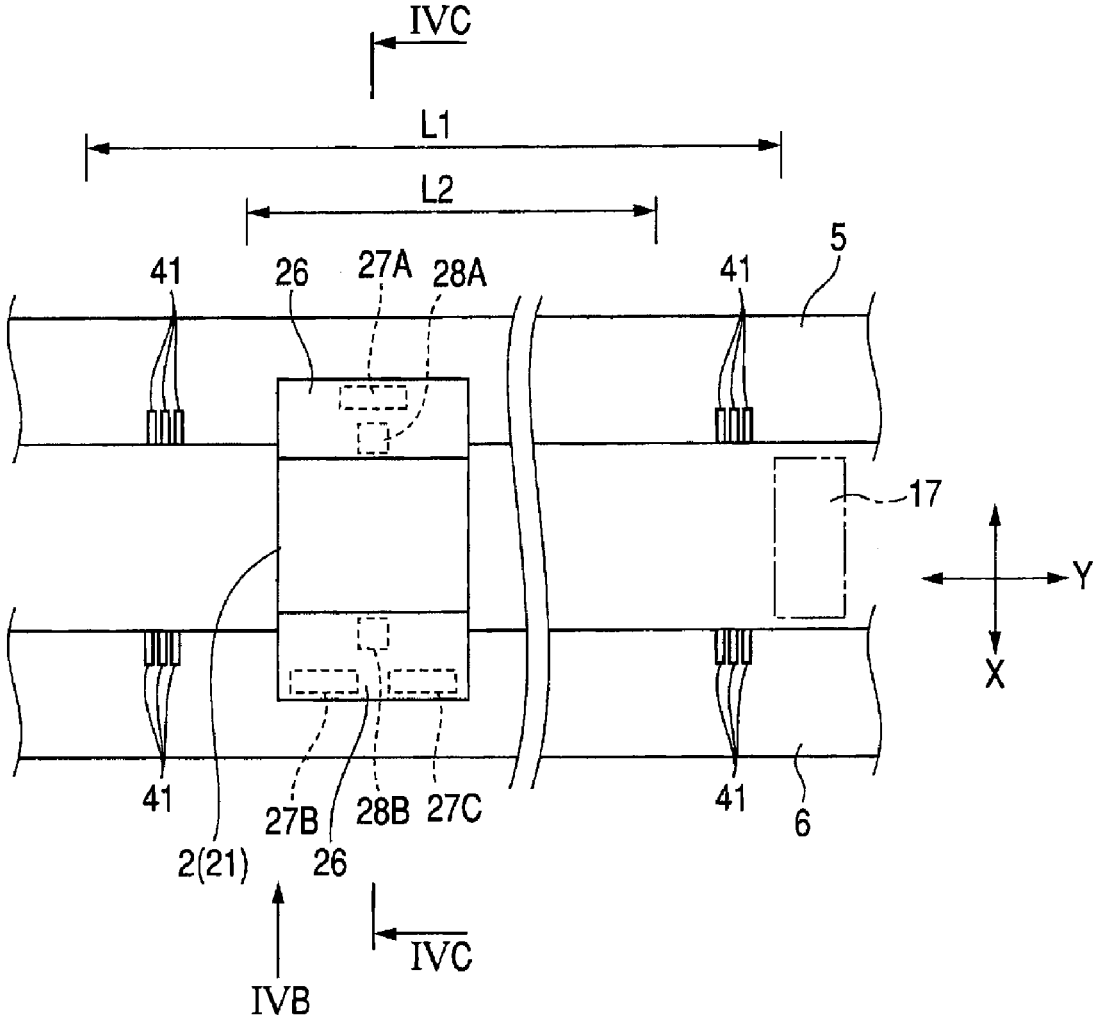
FIG. 4A is a schematic plan view for illustrating the carriage and first protruding sections provided to guide members according to the first embodiment.

As shown in FIG. 4A, the carriage 2 is configured to be movable reciprocatingly in the Y-axis direction within a moving range L1. Further, the recording head 3 ejects ink droplets onto the recording paper P within a recording range L2. As shown in FIG. 4A, the moving range L1 is wider (longer in the Y-axis direction) than the recording range L2. Note that the recording range L2 is determined so that the recording range L2 matches the width (the length in the Y-axis direction) of the largest recording paper P that can be recorded (conveyed) in the recording device 1.

A maintenance unit 17 is provided inside the moving range L1 and at one of the both outer sides (the right side in FIGS. 1 and 4A) of the recording range L2. The maintenance unit 17 performs cleaning of the recording head 3. The cleaning includes: a recovering operation (purge operation) of discharging deteriorated ink such as ink with increased viscosity from the nozzles 7; and a wiping operation of wiping off ink, paper powders, and the like adhering to the nozzle opening surface, which is the lower surface of the recording head 3.

As shown in FIG. 1, the maintenance unit 17 includes a wiping member 20 and a cap member 19 juxtaposed to each other, where the wiping member 20 is closer to the recording range than the cap member 19 is. The blade-shaped wiping member 20 is for wiping the nozzle opening surface. The cap member 19 is made of elastic material (for example, rubber, synthetic resin, or the like) and is connected to a suction pump (not shown). The cap member 19 and the wiping member 20 can be moved by a lift mechanism (not shown) in the up-down direction between a position at which the members 19 and 20 contact the nozzle opening surface and another position at which the members 19 and 20 are spaced away from the nozzle opening surface. Note that the up-down direction is the direction perpendicular both to the main scanning direction (Y-axis direction) and to the sub-scanning direction (X-axis direction).

During the recovering operation (purge operation), the cap member 19 is elevated to make close contact with the nozzle opening surface of the recording head 3, so that the cap member 19 covers all the nozzles 7. Then, the suction pump (not shown) connected to the cap member 19 forcibly sucks ink through the nozzles 7 and discharges ink. During the wiping operation, the recording head 3 is moved in the Y-axis direction while the wiping member 20 is in an elevated state (in other words, the wiping member 20 is relatively moved with respect to the recording head 3), thereby wiping the nozzle opening surface of the recording head 3.

A control unit 90 mounted on the main frame 12 controls the movement of the carriage 2 and the operations of the maintenance unit 17. During a recording operation, the control unit periodically moves the carriage 2 to the position in confrontation with the maintenance unit 17 to perform a series of cleaning operations (purge operation and wiping operation) for the recording head 3. In addition, the control unit executes the cleaning operations when ink cartridges are replaced, or when a user gives a command with a button operation or the like at desired timing (irregular timing).

Figure 2:
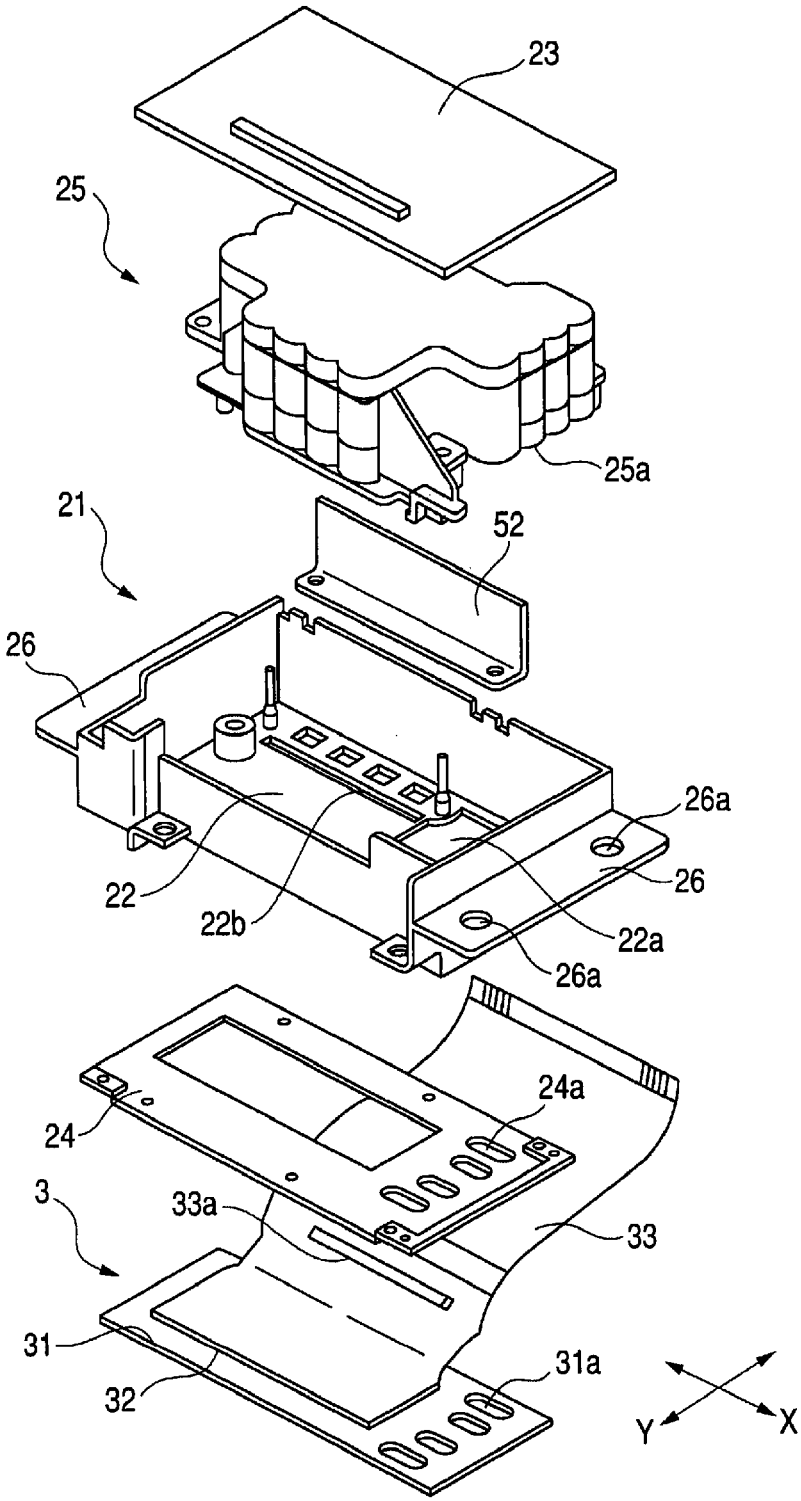
FIG. 2 is an exploded perspective view of a carriage of the recording device shown in FIG. 1.

As shown in FIG. 2, the carriage 2 includes the head holder 21 having a substantially open-box shape where the upper part is opened. The head holder 21 includes a bottom plate 22 having a lower surface in confrontation with the recording paper P. The recording head 3 is fixed to the lower surface of the bottom plate 22 with the nozzles 7 exposed downward. More specifically, a reinforcing frame 24 is interposed between the upper surface of the recording head 3 and the bottom plate 22, and is fixed to these components with adhesive or the like.

An ink storing section 25 and a circuit board 23 are mounted on the upper side of the bottom plate 22 of the head holder 21. The ink storing section 25 temporarily stores ink supplied from the ink cartridges 13. One end of a flexible wiring member 33 is connected to the recording head 3. In an assembled state (not shown), the flexible wiring member 33 extends through a slit 22*b* formed in the bottom plate 22, and the other end of the flexible wiring member 33 is connected to the circuit board 23. The flexible wiring member 33 is provided with a circuit element 33*a*. The circuit board 23 receives driving signals from the control unit 90 mounted on the main frame 12 via a flexible wiring cable (not shown), and supplies the driving signals to an actuator 32 of the recording head 3 via the circuit element 33*a* of the flexible wiring member 33. Further, a heat radiator 52 is provided at the upper side of the bottom plate 22. The heat radiator 52 is for radiating heat from the circuit element 33*a* mounted on the flexible wiring member 33.

As shown in FIG. 2, an opening 22*a* (through hole) is formed in the bottom plate 22 of the head holder 21. An ink exit hole 25*a* of the ink storing section 25 is in fluid communication with an entrance hole 31*a* of the recording head 3 via the opening 22*a* and via a communication hole 24*a* of the reinforcing frame 24.

Figure 3:
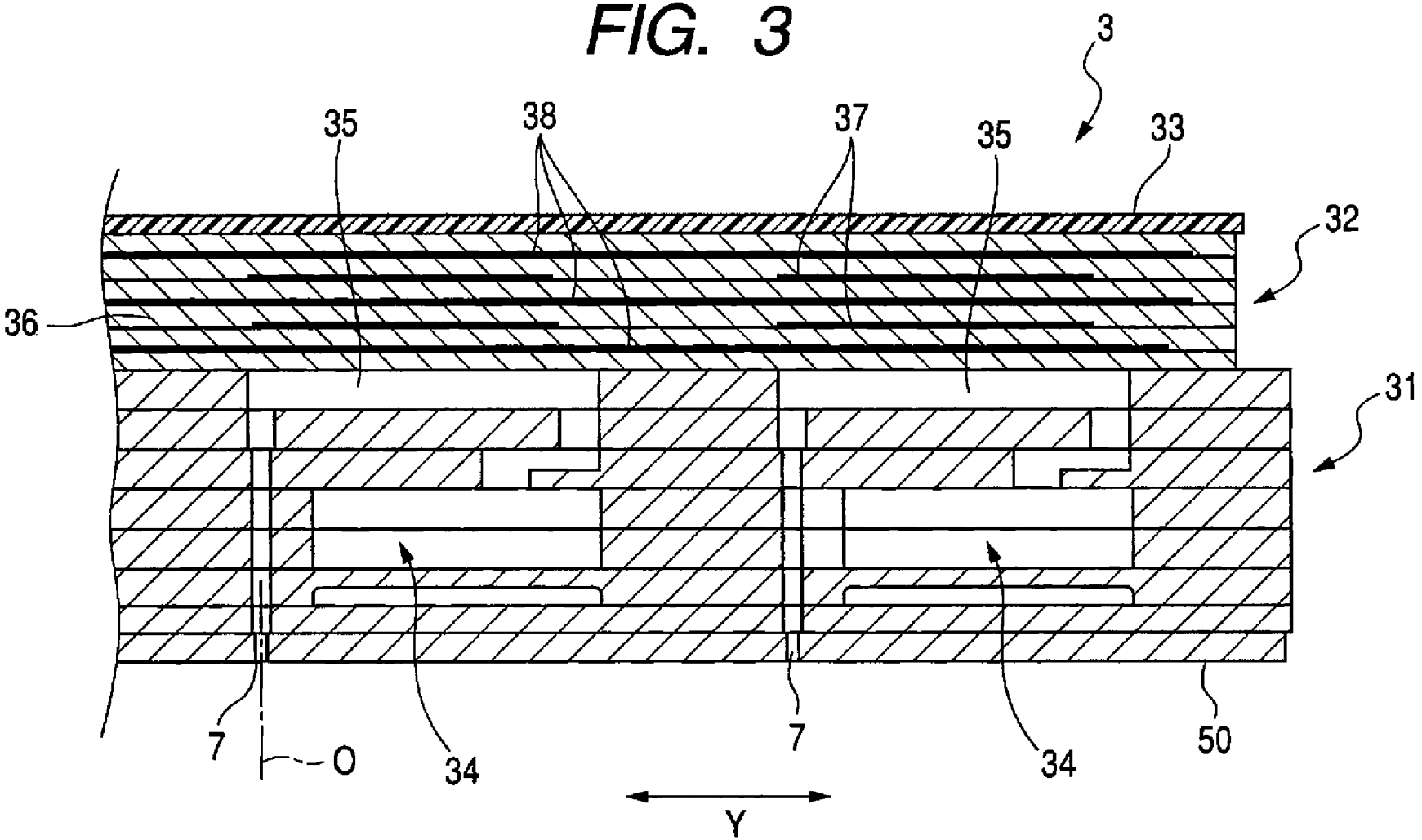
FIG. 3 is a vertical cross-sectional view of a recording head, taken along a Y-axis direction.

The recording head 3 is well-known in the art (for example, refer to Japanese Patent Application Publication No. 2005-322850). As shown in FIG. 3, the recording head 3 is constructed by stacking a cavity section 31, the actuator 32, and the flexible wiring member 33. The cavity section 31 is formed with a plurality of nozzles 7 each opened in its lower surface. Further, the cavity section 31 has a plurality of pressure chambers 35 at its upper surface side in one-to-one correspondence with the plurality of nozzles 7. The actuator 32 applies ejection pressure selectively to the pressure chambers 35. The flexible wiring member 33 outputs driving signals to the actuator 32.

As shown in FIG. 2, the plate-shaped carriage protruding members 26 are provided to the both side surfaces (parallel to the Y-axis direction) of the head holder 21. The carriage protruding members 26 protrude outward in the X-axis direction from the both side surfaces. Each of the carriage protruding members 26 is elongated in the Y-axis direction. The carriage protruding members 26 are formed with holes 26*a* for mounting sliding sections 27A, 27B, and 27C (FIGS. 4A through 4C) to be described later. The head holder 21 straddles and moves along the first guide member 5 and the second guide member 6, in such a manner that the lower surfaces of the carriage protruding members 26 are in sliding contact with the upper surfaces of the first guide member 5 and the second guide member 6. More specifically, sliding resistance becomes large if the entire lower surfaces of the carriage protruding members 26 slide on the guide members 5 and 6. Hence, portions (the sliding sections 27A, 27B, and 27C) of the lower surfaces of the carriage protruding members 26 protrude toward the guide members 5 and 6 to serve as a sliding surface.

Figure 4B:
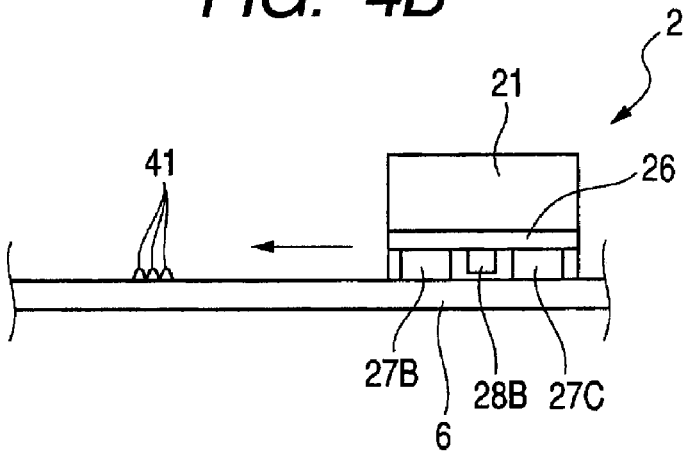
FIG. 4B is a schematic side view, as viewed from a direction shown by an arrow IVB in FIG. 4A.
Figure 4C:
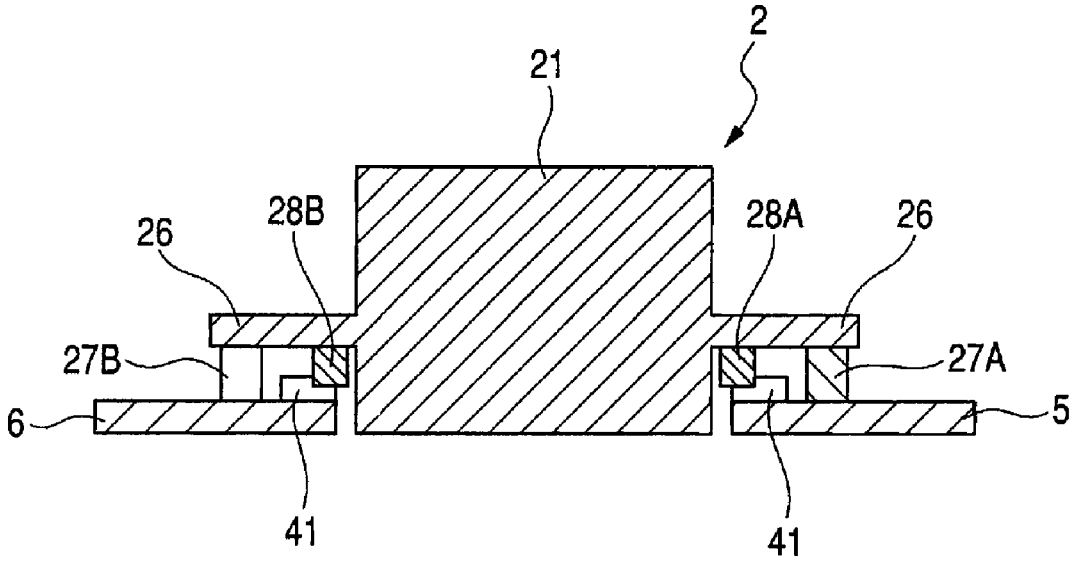
FIG. 4C is a schematic cross-sectional view taken along a line IVC-IVC in FIG. 4A.

The structure of the carriage protruding members 26 will be described in greater detail while referring to FIGS. 4A through 4C. As shown in FIGS. 4A through 4C, three sliding sections 27A, 27B, and 27C are provided on the lower surfaces of the carriage protruding members 26, wherein one sliding section 27A is provided to the carriage protruding member 26 at the first guide member 5 side, and two sliding sections 27B and 27C are provided to the carriage protruding member 26 at the second guide member 6 side. As shown in FIGS. 4A and 4C, the sliding sections 27A, 27B, and 27C are provided at positions that do not overlap first protruding sections 41 (to be described later) when viewed in the Y-axis direction. Hence, the sliding sections 27A, 27B, and 27C do not contact the first protruding sections 41 when the carriage 2 is moved in the Y-axis direction. In addition, engaging sections 28A and 28B are provided on the lower surfaces of the carriage protruding members 26, wherein one engaging section 28A is provided to the carriage protruding member 26 at the first guide member 5 side, and the other engaging section 28B is provided to the carriage protruding member 26 at the second guide member 6 side. As shown in FIGS. 4A and 4C, the engaging sections 28A and 28B are provided at positions that overlap the first protruding sections 41 when viewed in the Y-axis direction. Hence, the engaging sections 28A and 28B contact the first protruding sections 41 when the carriage 2 is moved in the Y-axis direction.

The three sliding sections 27A, 27B, and 27C are constantly in contact with the upper surfaces (guide surfaces) of the first and second guide members 5 and 6, except when the engaging sections 28A and 28B contact the first protruding sections 41 and vibration is generated. Thus, the carriage 2 is supported at three points in a stable manner. As shown in FIGS. 4B and 4C, the engaging sections 28A and 28B have smaller height than the sliding sections 27A, 27B, and 27C. Thus, when the carriage 2 is located at positions other than the first protruding sections 41, the engaging sections 28A and 28B are not in contact with the upper surfaces of the first and second guide members 5 and 6. However, when the carriage 2 passes the position where the first protruding sections 41 are provided, the engaging sections 28A and 28B contact the first protruding sections 41, thereby causing the carriage 2 to vibrate.

Multiple nozzles 7 for each of ink colors are arranged in a row in the X-axis direction. A plurality of rows of nozzles 7 are arranged in the Y-axis direction with intervals. The plurality of rows of nozzles 7 may be arranged in the Y-axis direction with equal intervals (equal distances). Alternatively, two of the plurality of rows may be closely located and the nozzles 7 in the two rows may be arranged in a staggered arrangement.

As shown in FIG. 3, the cavity section 31 is constructed by stacking a plurality of thin plates. A manifold chamber 34 is provided for each row of the pressure chambers 35. A series of ink supply channels are formed inside the cavity section 31, so that ink introduced in the entrance hole 31*a* (see FIG. 2) of the cavity section 31 from the ink storing section 25 is distributed to the plurality of pressure chambers 35 via the manifold chamber 34 and is finally supplied to the nozzles 7. As shown in FIG. 3, the nozzles 7 are opened on the lower surface of the cavity section 31 (nozzle opening surface). The plate having the nozzle opening surface is made by liquid-repellent material, or the nozzle opening surface is applied with treatment for giving liquid-repellency. With this liquid-repellency, an ink meniscus held within each nozzle 7 can be well formed.

Various types of actuators can be used as the actuator 32, such as a piezoelectric type, an electricity-heat conversion type, a type of driving a vibration plate with static electricity, and the like. In the example shown in FIG. 3, the actuator 32 of piezoelectric type is used where a plurality of flat piezoelectric ceramic layers 36 (for example, PZT: lead zirconium titanate) are stacked, and electrodes 37 and 38 are sandwiched therebetween. Note that the piezoelectric ceramic layers 36 have a size that covers all of the pressure chambers 35. The electrodes include individual electrodes 37 provided for respective ones of the pressure chamber 35 and common electrodes 38 shared by the plurality of pressure chambers 35. Voltages are applied to the individual electrodes 37 and the common electrodes 38 to displace the piezoelectric ceramic layers 36 interposed between the both electrodes, thereby applying pressure to ink within the pressure chambers 35 to eject ink through the nozzles 7.

Further, external electrodes (not shown) are provided on the uppermost surface of the actuator 32. The individual electrodes 37 and the common electrodes 38 are electrically connected to the external electrodes (not shown) via through holes (not shown in the drawings of the present application; for example, refer to FIGS. 7 and 8 of Japanese Patent Application Publication No. 2005-322850, which is incorporated herein by reference in its entirety). The external electrodes (not shown) are electrically connected to an electrode pattern (not shown) of the flexible wiring member 33. With this wiring arrangement, driving signals sent from the control unit 90 are inputted to the actuator 32 via the circuit element 33*a* mounted on the flexible wiring member 33.

As shown in FIG. 4A, in the first embodiment, the first protruding sections 41 are provided to each of the first guide member 5 and the second guide member 6 in the regions inside the moving range L1 and outside the recording range L2. The carriage 2 moves across the positions at which the first protruding sections 41 are provided, thereby generating vibration in the recording head 3 so that ink held in the nozzles 7 vibrates in such a manner that the vibration includes a component in an axis direction O of the nozzles 7 (see FIG. 3). Here, the vibration applied to the recording head 3 need not match the axis direction O of the nozzles 7 completely. As long as the vibration includes a component in the axis direction O, ink in the nozzles 7 can be vibrated in the axis direction O. In this embodiment, because ink is ejected from the nozzles 7 downward in the vertical direction, vibration including a component in the vertical direction is applied.

As shown in FIG. 4A, the first protruding sections 41 are provided at positions near the both ends of the first and second guide members 5 and 6 in the longitudinal direction (two positions on each guide member, four positions in total). The first protruding sections 41 on the first guide member 5 are aligned with the first protruding sections 41 on the second guide member 6 with respect to the positions in the Y-axis direction. Further, the first protruding sections 41 at the maintenance unit 17 side (the right side in FIGS. 1 and 4A) are located at positions closer to the recording range L2 than the maintenance unit 17 is.

More specifically, the first protruding sections 41 are provided on the upper surfaces of the first and second guide members 5 and 6 and at positions where the first protruding sections 41 can confront the carriage protruding members 26 of the carriage 2. Each piece of the first protruding sections 41 is a ridge-shaped protrusion extending in the X-axis direction. In the example shown in FIGS. 4A through 4C, the first protruding section 41 includes three ridge-shaped protrusions that are parallel to one another. However, the number of the protrusions is not limited to three, but may be one, two, or more than three. Additionally, in this embodiment, the first protruding sections 41 at four positions are all the same in height (protrusion height).

In the example shown in FIGS. 4A through 4C, the first protruding section 41 includes three ridge-shaped protrusions as described above. Thus, continuous vibrations can be applied to the carriage 2 when the carriage 2 moves across the three ridge-shaped protrusions of the first protruding section 41. However, protrusions may be provided with spaces (intervals) therebetween. In this case, intermittent vibrations can be applied to the carriage 2 when the carriage 2 moves across the spaced protrusions.

As described above, only portions (not the entirety) of the lower surfaces of the carriage protruding members 26 (the sliding sections 27A, 27B, and 27C) slide on the first and second guide members 5 and 6. The first protruding sections 41 are provided at positions corresponding to the engaging sections 28A and 28B provided on the lower surfaces of the carriage protruding members 26. Further, it is preferable that the side and top surfaces of each protrusion of the first protruding section 41 in the Y-axis direction be formed in a gentle (smooth) shape, in order to suppress wear and collision noise when the carriage 2 contacts the first protruding sections 41. The specific size and shape of the first protruding sections 41 are determined by experiments and the like.

With the above-described arrangement, the carriage protruding members 26 of the head holder 21 are merely placed on the first and second guide members 5 and 6. Accordingly, when the control unit 90 controls the carriage 2 to move across the positions where the first protruding sections 41 are provided, the entirety of the carriage 2 is temporarily displaced in the vertical direction (i.e., the protruding direction of the first protruding sections 41) and vibrates. The vibration of the carriage 2 causes the recording head 3 to vibrate, which applies inertia force to ink held in the nozzles 7. This inertia force causes ink held in the nozzles 7 to vibrate in the nozzle axis direction O (which is the vertical direction). Thus, ink in each nozzle 7 moves between inside of the nozzle 7 and the opening surface of the nozzle 7. With the vibration of ink, the meniscus formed in the opening of the nozzle 7 also vibrates, which prevents the meniscus from being continuously exposed to air. Thus, drying of ink (especially, ink of the meniscus formed in the opening of the nozzles 7) can be prevented.

Here, the magnitude of the above-described vibration is set so that the vibration does not brake a meniscus and ink held in the nozzle 7 is not ejected from the nozzle 7. Hence, wasteful consumption of ink can be prevented. In order to set the magnitude of vibration that does not brake a meniscus, the specific size and shape of the first protruding sections 41 are determined by experiments and the like, as mentioned above.

When ink is ejected from the recording head 3 onto the recording paper P for recording, the ejection frequency of particular nozzles 7 sometimes becomes extremely low depending on a recorded image. However, because the carriage 2 is vibrated in this embodiment, ink (meniscus) in all the nozzles 7 can be vibrated all together. Thus, ink in the nozzles 7 with low ejection frequency can be vibrated and stirred, which prevents drying of ink.

With the above-described arrangement, the first protruding sections 41 are provided at the positions that contact the engaging sections 28A and 28B provided to the carriage 2, and the entirety of the carriage 2 is vibrated mechanically in order to stir ink in the nozzles 7. Hence, there is no need to drive the actuator 32. That is, wasteful consumption of ink and heating of the actuator 32 can be suppressed, compared with the case where the actuator 32 is driven to apply micro-vibration to a meniscus or to perform flushing ejection. Consequently, this suppresses instable ejection of the recording head 3 due to an increase in the amount of heat generation of the actuator 32. Further, the electrical power consumed for recovering the ejection performance can be suppressed.

Further, in the first embodiment, the first protruding sections 41 are provided outside the recording range L2 (the range in which the carriage 2 moves while the nozzles 7 are in confrontation with the recording paper P). Accordingly, the first protruding sections 41 do not affect recording operations during which ink is ejected from the nozzles 7 onto the recording paper P.

In the above-described first embodiment, the first protruding sections 41 at four positions are all the same in height (protrusion height). However, the protrusion heights may be set in such a manner that the first protruding sections (for example, one side in the Y-axis direction, the left side in FIG. 4A) is different from the first protruding sections (for example, the other side in the Y-axis direction, the right side in FIG. 4A). With this arrangement, the magnitude of vibration applied to the recording head 3 and ink therein can be made different between the case when the engaging sections 28A and 28B of the carriage protruding members 26 contact the higher protruding sections and the case when the engaging sections 28A and 28B contact the lower protruding sections.

The control unit 90 (see FIG. 1) functions as an ejection-frequency detecting section. Alternatively, the ejection-frequency detecting section may be provided to the circuit board 23 or the circuit element 33*a*. The ejection-frequency detecting section detects the frequency of ejection from the nozzles 7 onto the recording paper P. Specifically, the ejection-frequency detecting section acquires image data inputted from an external device (not shown) such as a personal computer, and determines the frequency of ejection of each nozzle 7 for the image data. In addition, the ejection-frequency detecting section stores the time period from the previous ejection until the present time for each nozzle 7 (in a state where the recording device 1 is powered on), and determines the frequency of ejection of each nozzle 7 based on this time period. If the ejection frequency is low, the time period from the previous vibration until the next vibration can be set to a shorter period, or the magnitude of the vibration can be made larger. Conversely, if the ejection frequency is high, the time period from the previous vibration until the next vibration can be set to a longer period, or the magnitude of the vibration can be made smaller.

More specifically, if the ejection frequency is high during the time period from the previous vibration until the present time, ink is ejected frequently from the nozzles 7 and ink in the nozzles 7 does not tend to dry. Thus, even if the frequency of vibrating the recording head 3 is low, drying of ink in the nozzles 7 can be prevented sufficiently. Hence, the number of times of contacts between the carriage 2 (the engaging sections 28A and 28B) and the first protruding sections 41 can be reduced, thereby suppressing wear of the carriage 2 and the first protruding sections 41. Further, if the ejection frequency is high, drying of ink in the nozzles 7 can be prevented with small vibration. Thus, the contact area between the carriage 2 and the first protruding sections 41 can be reduced by using small (or low in the protruding height) first protruding sections 41, thereby suppressing wear of the carriage 2.

In the present embodiment, the first protruding sections 41 and the control unit 90 that controls the carriage motor 8 function as a vibration generating section.

Figure 5A:
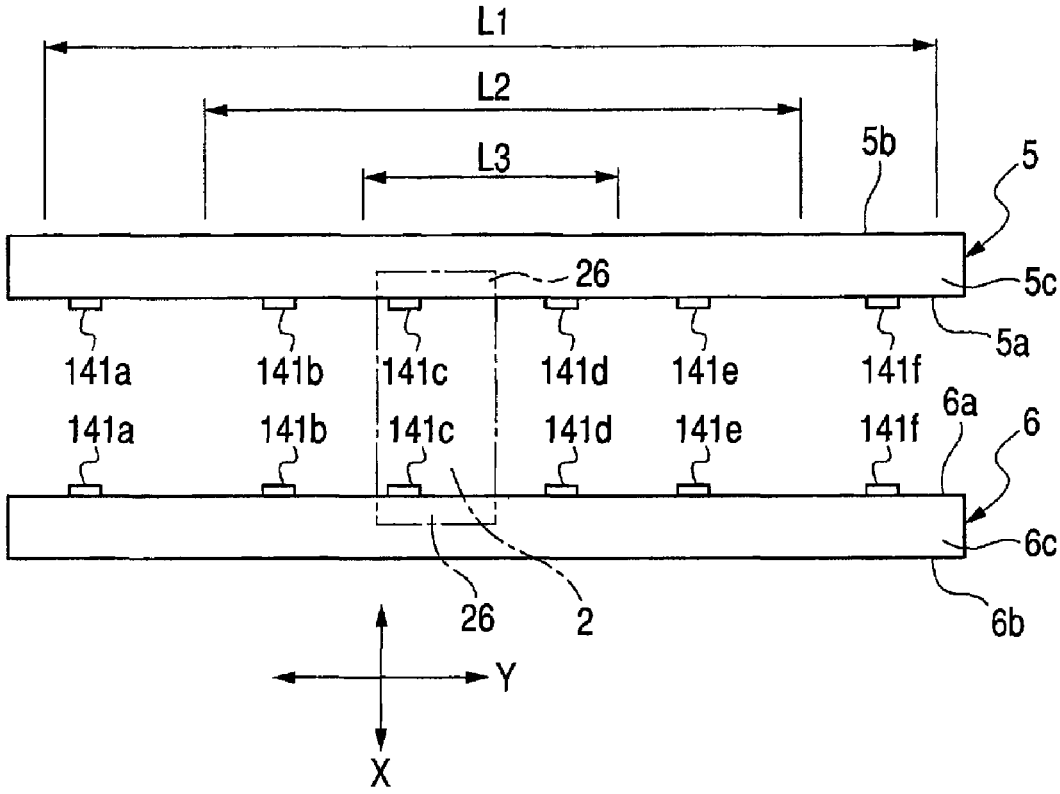
FIG. 5A is a schematic plan view for illustrating first protruding sections provided to guide members according to a second embodiment of the invention.

Next, a droplet ejecting device according to a second embodiment of the invention will be described while referring to FIGS. 5A through 5C, wherein like parts and components are designated by the same reference numerals to avoid duplicating description. In the second embodiment, movable first protruding sections 141 are provided to the first and second guide members 5 and 6. More specifically, the first protruding sections 141 are provided to side surfaces 5*a* and 6*a* of the first and second guide members 5 and 6, the side surfaces 5*a* and 6*a* being parallel to the Y-axis direction and being in confrontation with each other (the inward side surfaces). The first protruding sections 141 are provided inside the moving range L1 (both inside and outside the recording range L2) at a plurality of positions with predetermined intervals in the Y-axis direction. The first protruding sections 141 on the first guide member 5 are aligned with the first protruding sections 141 on the second guide member 6 with respect to the positions in the Y-axis direction.

Note that, in the present embodiment, the first and second guide members 5 and 6 are plate-shaped members with relatively large width in the X-axis direction (see FIG. 1). Thus, the first protruding sections 141 are provided to the inward side surfaces 5*a* and 6*a* as described above. However, if the carriage protruding members 26 of the carriage 2 are longer in the X-axis direction, the first protruding sections 141 may be provided to outward side surfaces 5*b* and 6*b* of the first and second guide members 5 and 6. In addition, it is not necessary that the first protruding sections 141 contact the lower surfaces (sliding surfaces) of the carriage protruding members 26 of the carriage 2, as long as the first protruding sections 141 can contact some portion of the carriage 2 to lift the carriage 2. For example, as illustrated in the first embodiment, sliding sections (27A, 27B, and 27C in the first embodiment) and engaging sections (28A and 28B in the first embodiment) may be provided so that the first protruding sections 141 can contact the engaging sections, not the sliding sections. Further, similar to the first embodiment, the positions of the first protruding sections 141 are not limited to the first and second guide members 5 and 6.

Figure 5B:
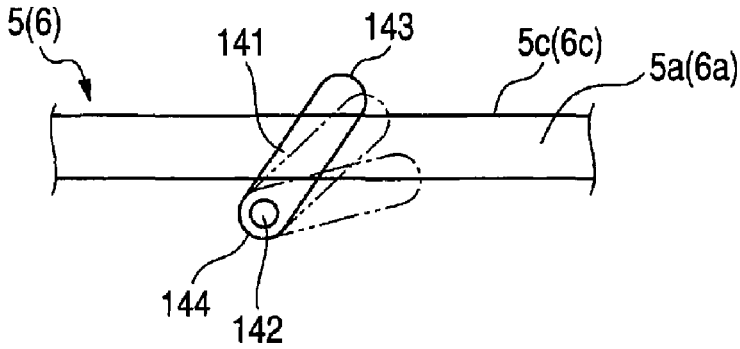
FIG. 5B is a schematic side view for illustrating the first protruding sections provided to the guide members according to the second embodiment.
Figure 5C:
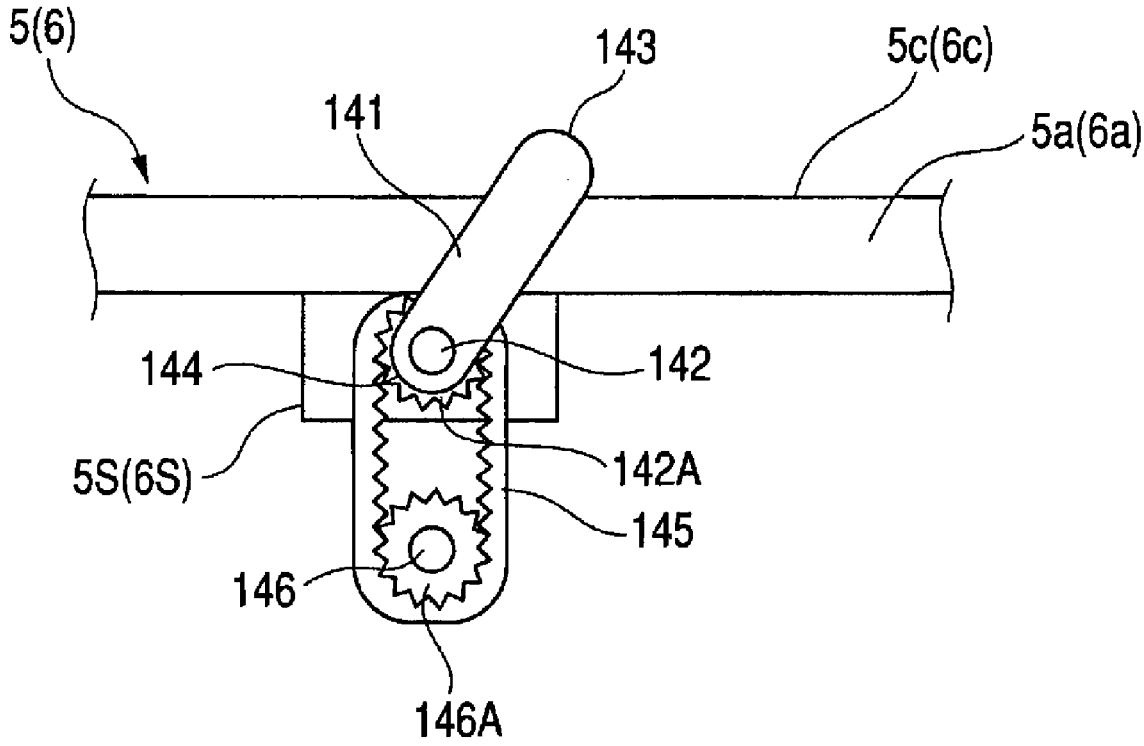
FIG. 5C is a schematic side view for particularly illustrating the driving mechanism of the first protruding section shown in FIG. 5B.

As shown in FIG. 5B, the first protruding sections 141 are elongated plate-shaped or rod-shaped members. Each of the first protruding sections 141 has a base end 144 and a distal end 143 (upper end) opposite the base end 144 in the longitudinal direction. The base end 144 of each first protruding section 141 is pivotally supported by a first drive shaft 142 at the lower side of the first or second guide member 5 or 6. As shown in FIG. 5C, the first drive shaft 142 is rotatably supported by a support section 5S or 6S provided to the lower side of the first or second guide member 5 or 6, respectively. The first drive shaft 142 is provided with a gear 142A. Further, a second drive shaft 146 is provided below the first drive shaft 142. The second drive shaft 146 is connected to an output shaft of a rotational driving source (not shown in the drawing and, for example, a stepping motor) and is supplied with rotational driving force from the rotational driving source. The second drive shaft 146 is provided with a gear 146A. A gear belt 145 having an internal gear is looped around the gears 146A and 142A. Thus, when rotational driving force is supplied to the second drive shaft 146, the rotational driving force is transmitted to the first drive shaft 142 via the gear 146A, the gear belt 145, and the gear 142A. When the first drive shaft 142 is rotated in one direction, the upper end 143

(distal end) is swingably moved to protrude from an upper surface 5*c* of the first guide member 5 or an upper surface 6*c* of the second guide member 6. When the first drive shaft 142 is rotated in the opposite direction, the upper end 143 is swingably moved to be retracted below the upper surface 5*c* or 6*c*.

More specifically, the upper end 143 of each first protruding section 141 is movable between a first position where the upper end 143 protrudes upward from the upper surface 5*c* or 6*c* of the first or second guide member 5 or 6 (that is, the position where the upper end 143 can contact the carriage protruding member 26 of the carriage 2 and the position shown in the solid lines in FIG. 5B) and a second position where the upper end 143 does not protrude from the upper surface 5*c* or 6*c* of the first or second guide member 5 or 6 (that is, the position where the upper end 143 does not contact the carriage protruding member 26 and the position shown in the single-dot chain lines in FIG. 5B). The amount of protrusion of the upper end 143 from the upper surface 5*c* or 6*c* when the upper end 143 is at the first position is set so that the carriage 2 is applied with vibration to an extent that ink is held (retained) in the nozzles 7 without being ejected. Note that, when the carriage 2 is moved and the carriage protruding members 26 contact the first protruding sections 141, the first protruding sections 141 stay at the first position (protruding position) and the carriage protruding members 26 slide over the first protruding sections 141.

In this example, two positions (the first position and the second position) having difference in height can be selected as the amount of protrusion of the first protruding section 141. However, in addition to these two positions, the amount of protrusion may be adjusted more finely by adjusting the amount of rotation of the first drive shaft 142, thereby adjusting the magnitude of vibration, depending on various conditions such as the last ejection frequency of the nozzles 7 detected by the ejection-frequency detecting section. Hence, the magnitude of vibration of ink in the nozzle axis direction O can be adjusted. More specifically, when the ejection frequency is relatively low, the amount of protrusion of the first protruding section 141 is set to a larger value to apply large vibration (for example, the solid lines in FIG. 5B). Conversely, when the ejection frequency is relatively high, the amount of protrusion of the first protruding section 141 is set to a smaller value to apply small vibration (for example, the double-dot chain lines in FIG. 5B). With this arrangement, ink in the nozzles 7 can be applied with vibration required for recovering the ejection performance, depending on the state of drying. Additionally, the contact area between each first protruding section 141 and the carriage 2 is not unnecessarily large, thereby preventing unnecessary wear due to the contact between the first protruding section 141 and the carriage 2.

In the example shown in FIG. 5A, six first protruding sections 141 are arranged at each of the first and second guide members 5 and 6. The six first protruding sections 141 are referred to as first protruding sections 141*a*, 141*b*, 141*c*, 141*d*, 141*e*, and 141*f* from the left side of the FIG. 5A. All the first protruding sections 141*a*-141*f* are arranged inside the moving range L1. Of these, the first protruding sections 141*a* and 141*f* are arranged outside the recording range L2, and the first protruding sections 141*c* and 141*d* are arranged inside a third range L3 that is smaller than the recording range L2 in the Y-axis direction.

For example, when ink is ejected from the nozzles 7 of the recording head 3 onto the recording paper P having width (the length in the Y-axis direction) of the recording range L2, at least the first protruding sections 141*b*-141*e* located inside the recording range L2 are held at the second position where the upper end 143 does not protrude from the upper surface 5*c* or 6*c* of the first or second guide member 5 or 6. Hence, when the carriage 2 is scanningly moved within the recording range L2, the first protruding sections 141*b*-141*e* do not apply vibration to the carriage 2.

Normally, the carriage 2 is scanned a plurality of times reciprocatingly in the Y-axis direction, in order to perform recording on a single recording paper P. In the case where the recording type is one-way recording, the carriage 2 is scanned in one direction while ejecting ink droplets, and the carriage 2 is scanned in the opposite direction without ejecting ink droplets. Accordingly, when the carriage 2 is scanned in the opposite direction, the first protruding sections 141*b*-141*e* is swingably moved so that the upper end 143 is held at the first position where the upper end 143 protrudes from the upper surface 5*c* or 6*c* of the first or second guide member 5 or 6. Then, each time the carriage 2 contacts one of the first protruding sections 141*b*-141*e*, the carriage 2 is vibrated so that ink (meniscus) held in all the nozzles 7 can be vibrated slightly. With this arrangement, ink can be vibrated efficiently by utilizing the intervals between ink ejections onto the recording paper P. Hence, the time period for recording can be shortened compared with the conventional technique with which the carriage is moved to a flushing position or the like to eject ink for preventing drying of ink.

On the other hand, in the case where the recording type is two-way recording, the carriage 2 is scanned in the both directions while ejecting ink droplets. In this case, when vibration of ink becomes necessary, one reciprocating scan without ink ejection is performed between one reciprocating scan with ink ejection and another reciprocating scan with ink ejection. At this time, the conveyance of the recording paper P in the X-axis direction is temporarily stopped. During this one reciprocating scan without ink ejection, the upper ends 143 of the first protruding sections 141*b*-141*e* are held at the first position (where the upper end 143 protrudes from the upper surface 5*c* or 6*c* of the first or second guide member 5 or 6), thereby slightly vibrating the recording head 3 and thus ink (meniscus) held in all the nozzles 7.

Further, when ink is ejected from the nozzles 7 of the recording head 3 onto the recording paper P having width (the length in the Y-axis direction) of the third range L3 smaller than the recording range L2, the first protruding sections 141 are driven to move to the first position (where the first protruding sections 141 protrude from the upper surface 5*c* or 6*c* of the first or second guide member 5 or 6) to apply vibration to the carriage 2, as described above. In this case, however, it is only necessary to drive the first protruding sections 141*c* and 141*d* located within the third range L3 (the range of the length L3 in the Y-axis direction).

That is, in the second embodiment, the first protruding sections 141 are provided at a plurality of positions in the Y-axis direction. Hence, in a state where all the first protruding sections 141 are held at the first position, vibration can be efficiently applied to the carriage 2 a plurality of times by scanning the carriage 2 in the moving range L1 along the Y-axis direction only one time. Further, the first protruding sections 141 may be selectively moved to the first position (protruding position), depending on the width (the length in the Y-axis direction) of the recording paper P.

The first protruding sections 141*a* and 141*f* arranged outside the recording range L2 may be always held at the first position. Alternatively, the first protruding sections 141*a* and 141*f* may be temporarily moved to the first position at timing when the carriage 2 moves to the position in confrontation with the maintenance unit 17.

In the above-described second embodiment, each of the first protruding sections 141 is configured to be movable (displaceable) between: the position where the first protruding section 141 can contact the carriage 2; and the position where the first protruding section 141 does not contact the carriage 2. Accordingly, the first protruding sections 141 can be provided, regardless of inside or outside of the recording range L2 in which the carriage 2 moves while the nozzles 7 are in confrontation with the recording paper P. The first protruding sections 141 can be moved to the contacting position at desired timing (when the first protruding sections 141 are required to contact the carriage 2).

In the above-described second embodiment, each of the first protruding sections 141 is configured to be movable independently, and the control unit 90 can control driving of each of the first protruding sections 141. However, the first protruding sections 141 may be divided into a plurality of groups (for example, a first group including the first protruding sections 141*a* and 141*f*, a second group including the first protruding sections 141*b* and 141*e*, and a third group including the first protruding sections 141*c* and 141*d*), and the first protruding sections 141 in each group may be configured to be movable together. In this case, the control unit 90 can control driving of each group of the first protruding sections 141.

The configuration and method of driving the first protruding sections 141 to protrude from the upper surface 5*c* or 6*c* of the first or second guide member 5 or 6 are not limited to those in the above-described second embodiment, and many variations are possible. For example, in a third embodiment shown in FIG. 6A and in a fourth embodiment shown in FIG. 6B, through holes 242 are formed in the first and second guide members 5 and 6, and first protruding sections 241 inserted in the through holes 242 are configured to protrude from the upper surfaces 5*c* and 6*c*.

A droplet ejecting device according to the third embodiment of the invention will be described while referring to FIG. 6A, wherein like parts and components are designated by the same reference numerals to avoid duplicating description.

Figure 6A:
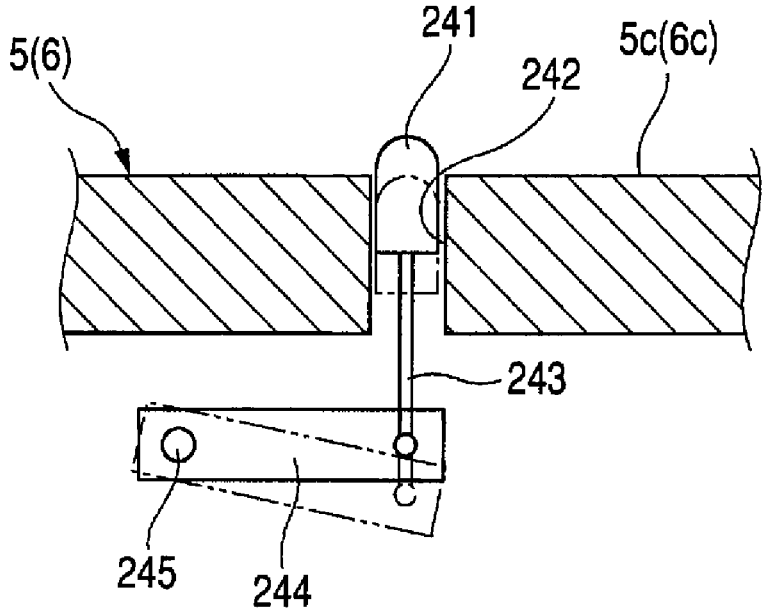
FIG. 6A is a schematic side view (cross-section in part) for illustrating a first protruding section provided to a guide member according to a third embodiment of the invention.

In the third embodiment shown in FIG. 6A, a support section 243 is attached to the lower end of each first protruding section 241, where the support section 243 is a rod-shaped member extending downward from the lower end of the first protruding section 241. The lower end of the support section 243 is rotatably supported by the distal end of a pivot member 244 that is arranged at the lower side of the first or second guide member 5 or 6. The base end of the pivot member 244 is fixed to a drive shaft 245 that is connected to a drive source (not shown), so that the pivot member 244 can rotatably move (pivotally move) together with the drive shaft 245.

More specifically, when the drive shaft 245 rotates, the distal end of the pivot member 244 rotatably moves upward (pivotally moves from the state shown in the double-dot chain lines to the state shown in the solid lines). Then, the distal end of the pivot member 244 pushes the support section 243 upward, which further pushes the first protruding section 241 upward while being guided by the through hole 242. Accordingly, by changing the rotation angle of the drive shaft 245, the first protruding section 241 can be moved between: a first position where the first protruding section 241 protrudes upward from the upper surface 5*c* or 6*c* of the first or second guide member 5 or 6; and a second position where the first protruding section 241 is retracted below the upper surface 5*c* or 6*c*. In this case, the amount of protrusion of the first protruding section 241 from the upper surface 5*c* or 6*c* can be also adjusted by changing the rotation angle of the drive shaft 245.

Figure 6B:
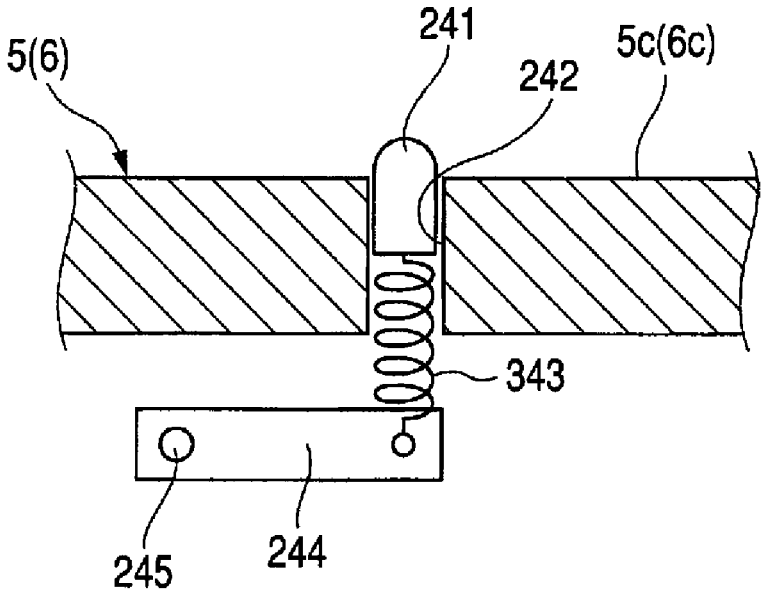
FIG. 6B is a schematic side view (cross-section in part) for illustrating a first protruding section provided to a guide member according to a fourth embodiment of the invention.

Next, a droplet ejecting device according to the fourth embodiment of the invention will be described while referring to FIG. 6B, wherein like parts and components are designated by the same reference numerals to avoid duplicating description.

In the fourth embodiment, the support section 243 of the third embodiment is substituted by an elastic support section 343 made by an elastic member such as a coil spring or the like. In the fourth embodiment, when the carriage 2 (the carriage protruding member 26) contacts the first protruding section 241 protruding from the upper surface 5*c* or 6*c* of the first or second guide member 5 or 6, the elastic support section 343 is elastically compressed so that the first protruding section 241 is retracted into the through hole 242. This arrangement of the fourth embodiment can reduce the contact noise that is generated due to the contact between the carriage 2 and the first protruding section 241.

In the above-described first through fourth embodiments, vibration can be applied to the carriage 2 by the scanning movement of the carriage 2. Hence, vibration can be applied to the recording head 3 by moving the carriage 2 continuously or intermittently when the recording head 3 is waiting (standing by) for an ejection command (for example, when no ink droplet is ejected from the nozzles 7 for a predetermined time period) in a state where the recording device 1 is powered on. Thus, drying of ink can be prevented during the standby state Further, in the above-described first through fourth embodiments, the first protruding sections 41, 141, or 241 are provided to the first and second guide members 5 and 6. However, the first protruding sections may be provided to any positions within the range in which the carriage 2 passes, when viewed in the vertical direction. In other words, the positions of the first protruding sections are not limited, as long as the first protruding sections can contact and apply vibration to the carriage 2 when the carriage 2 is scanningly moved. For example, the first protruding sections may be provided to a member located between the first guide member 5 and the second guide member 6, or may be provided to a member extending from the casing of the recording device 1, or may be provided to the maintenance unit 17.

In the above-described second through fourth embodiments, the movable first protruding sections 141 or 241 are provided to the first and second guide members 5 and 6 that guide the scanning movement of the carriage 2. However, movable protruding sections can be provided to the carriage 2 side, as will be described below.

A droplet ejecting device according to a fifth embodiment of the invention will be described while referring to FIGS. 7A and 7B, wherein like parts and components are designated by the same reference numerals to avoid duplicating description.

Figure 7A:
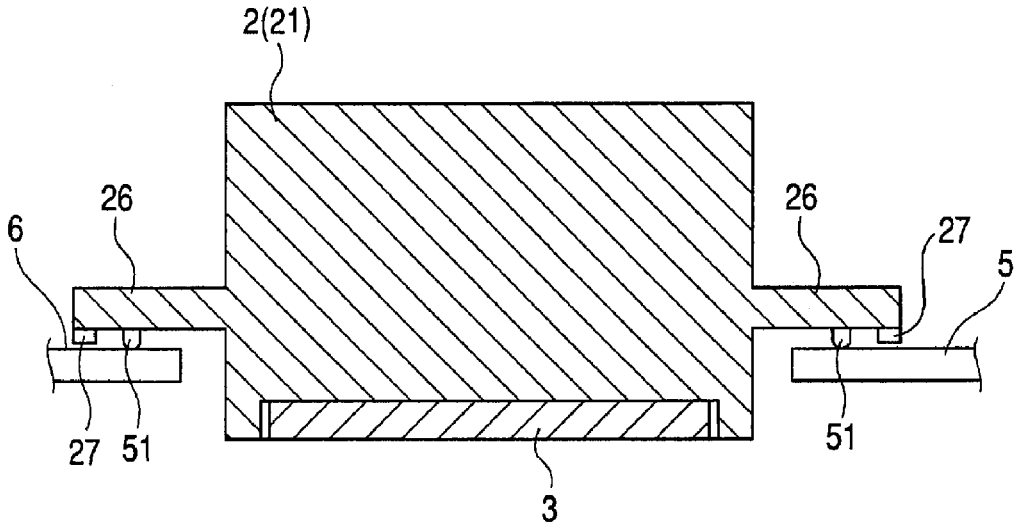
FIG. 7A is a schematic cross-sectional view for illustrating second protruding sections provided to a carriage according to a fifth embodiment of the invention.
Figure 7B:
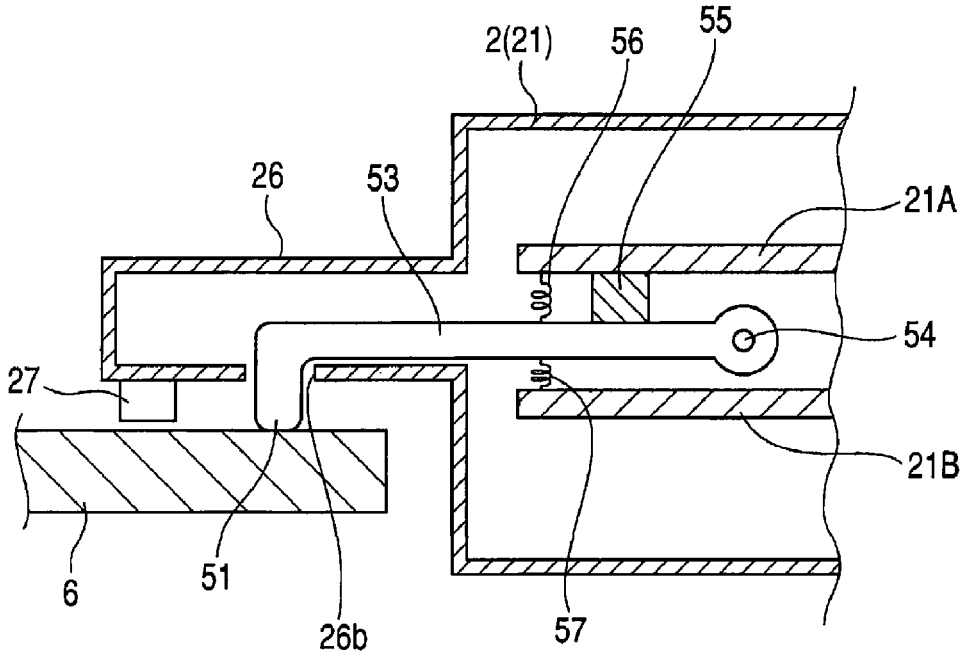
FIG. 7B is an enlarged schematic cross-sectional view for illustrating the driving mechanism of the second protruding section according to the fifth embodiment.

In the fifth embodiment shown in FIGS. 7A and 7B, sliding sections 27 are provided to the lower surface of the carriage protruding members 26. The sliding sections 27 slide on the upper surfaces of the first and second guide members 5 and 6 when the carriage 2 is scanningly moved. Additionally, movable second protruding sections 51 are provided to the carriage 2. More specifically, as shown in FIG. 7A, the movable second protruding sections 51 are provided to the lower surfaces of the carriage protruding members 26 of the carriage 2. FIGS. 7A and 7B show a state where the second protruding sections 51 are driven to protrude downward. When the second protruding sections 51 are driven to protrude downward at appropriate timing, the carriage 2 is slightly lifted from the first and second guide members 5 and 6. In this state (see FIGS. 7A and 7B), the sliding sections 27 are slightly spaced away from the upper surfaces of the first and second guide members 5 and 6. In contrast, when the second protruding sections 51 are driven to be retracted into the lower surfaces of the carriage protruding members 26, the carriage 2 is lowered, so that the sliding sections 27A, 27B, and 27C again contact the upper surfaces of the first and second guide members 5 and 6. Due to this impact, ink in the nozzles 7 of the recording head 3 can be vibrated.

More specifically, the second protruding section 51 can be moved as described below. As shown in FIG. 7B, the second protruding section 51 is the distal end of a rod-shaped member 53 provided within the head holder 21. Support sections 21A and 21B are fixed to the head holder 21 and are provided above and below the rod-shaped member 53, respectively. The base end of the rod-shaped member 53 is pivotally supported by a pivot shaft 54, so that the second protruding section 51 can protrude and be retracted through a hole 26*b* formed in the carriage protruding member 26. A piezoelectric element 55 is provided between the support section 21A and the rod-shaped member 53. The piezoelectric element 55 can be applied with a voltage from the same power source as used for driving the recording head 3. However, the piezoelectric element 55 are capable of displacing by a larger amount than the piezoelectric elements used for driving the recording head 3. A spring 56 is also provided between the support section 21A and the rod-shaped member 53. Another spring 57 is provided between the support section 21B and the rod-shaped member 53. With this arrangement, when a voltage is applied to the piezoelectric element 55, the piezoelectric element 55 expands in the vertical direction to push the rod-shaped member 53 downward. At this time, the second protruding section 51 protrude through the hole 26*b* by an amount larger than the height of the sliding section 27. Then, the second protruding section 51 strikes the upper surface of the first or second guide member 5 or 6, thereby generating vibration of the carriage 2. After that, rod-shaped member 53 returns to its original position with assistance of the springs 56 and 57. Thus, the second protruding section 51 is retracted into the hole 26*b*, so that the sliding section 27 again contacts the upper surface of the first or second guide member 5 or 6. In the present embodiment, the amount of protrusion of the second protruding section 51 can be adjusted by changing the voltage applied to the piezoelectric element 55.

Because the second protruding sections 51 are configured to adjust the amount of protrusion, the distance between the carriage 2 and the first or second guide member 5 or 6 can be changed when the second protruding section 51 contacts the first or second guide member 5 or 6. Hence, because the amount of displacement of the carriage 2 can be changed, the magnitude of vibration of ink in the nozzle axis direction O can be changed.

The above-described ejection-frequency detecting section may be provided to the recording device of the present embodiment. Then, the effects similar to those described in the first embodiment can be obtained.

A droplet ejecting device according to a sixth embodiment of the invention will be described while referring to FIG. 8, wherein like parts and components are designated by the same reference numerals to avoid duplicating description.

Figure 8:
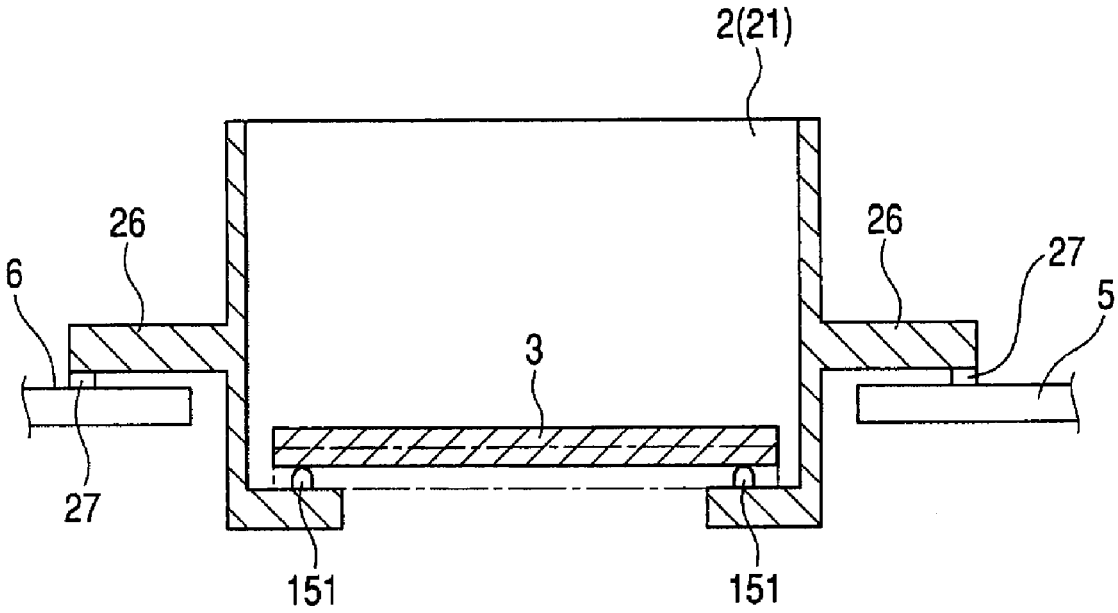
FIG. 8 is a schematic cross-sectional view for illustrating second protruding sections provided to a carriage according to a sixth embodiment of the invention.

According to the sixth embodiment schematically shown in FIG. 8, movable second protruding sections 151 are provided to the head holder 21 of the carriage 2 in such a manner that the second protruding sections 151 contact the recording head 3. FIG. 8 shows a state where the recording head 3 is lifted by the second protruding sections 151. That is, in this embodiment, the recording head 3 is not fixed to the head holder 21, and the movable second protruding sections 151 directly vibrate the recording head 3. The second protruding sections 151 can be driven by using a piezoelectric element, for example, as illustrated in the fifth embodiment.

In the above-described fifth and sixth embodiments, the movable second protruding sections 51 or 151 are provided to the carriage 2. Hence, regardless of whether the carriage 2 is scanningly moved, the movable second protruding sections 51 or 151 can be driven to protrude at timing when vibration is necessary and when ink is not being ejected onto the recording paper P, thereby applying continuous or intermittent vibration to ink in the nozzles 7. Accordingly, vibration can be applied at appropriate timing when the recording head 3 is standing by for an ejection command and the carriage 2 is at a standby position such as a position in confrontation with the maintenance unit 17 (home position) in a state where the recording device 1 is powered on (for example, when no ink droplet is ejected from the nozzles 7 for a predetermined time period). Thus, drying of ink can be prevented during the standby state.

While the invention has been described in detail with reference to the above aspects thereof, it would be apparent to those skilled in the art that various changes and modifications may be made therein without departing from the scope of the claims.

For example, in the above-described first embodiment (see FIGS. 4A through 4C), the engaging sections 28A and 28B configured to contact the first protruding sections 41 are provided separately from the sliding sections 27A, 27B, and 27C. However, it may be configured that no separate engaging sections are provided and that the sliding sections also function as the engaging sections.

In the first embodiment, the first protruding sections 41 are provided for applying vibration to the carriage 2 and ink in the nozzles 7. However, in the case where the sliding sections also function as the engaging sections, concave sections (not protruding sections) such as grooves may be provided for applying vibration to the carriage 2 and ink in the nozzles 7. In this case, when the sliding sections contact the concave sections, vibration is generated in ink in the nozzles 7.

In the above-described embodiments, the first protruding sections 41 and 141 and the second protruding sections 51 and 151 are provided at the both sides of the first and second guide members 5 and 6 (the both sides in the X-axis direction). However, the first and second protruding sections may be provided at only one side of the first and second guide members 5 and 6.

Further, in the above-described first and second embodiments, the first protruding sections 41 and 141 are provided to both of the first and second guide members 5 and 6 and at the same position with respect to the Y-axis direction. However, the first protruding sections may be provided to the first and second guide members 5 and 6 and at different positions with respect to the Y-axis direction (for example, in a staggered arrangement).

Further, in the first through fourth embodiments, the first protruding sections 41, 141, and 241 are provided. In the fifth and sixth embodiments, the second protruding sections 51 and 151 are provided. However, both of the first protruding sections and the second protruding sections may be provided.

The applications of the above-described droplet ejecting device are not limited to a recording device provided with an inkjet-type recording head. The droplet ejecting device may be applied to a device that ejects another kind of liquid, such as a device that ejects electrically conductive liquid onto a flexible insulating substrate to form a circuit pattern, a device that ejects dyeing liquid onto cloth, and the like.

What is claimed is:

1. A droplet ejecting device comprising:

a droplet ejecting head formed with at least one nozzle and configured to eject a liquid droplet through the at least one nozzle in a nozzle axis direction, the droplet ejecting head comprising an actuator that applies pressure to a part of a liquid channel in fluid communication with a corresponding one of the at least one nozzle;

a carriage that supports the droplet ejecting head;

a guide member extending in a predetermined direction and configured to guide the carriage so that the carriage is movable in the predetermined direction;

a moving section that moves the carriage along the guide member, the droplet ejecting head being configured to eject a liquid droplet through the at least one nozzle onto an ejection object while the moving section moves the carriage; and a vibration generating section that vibrates the droplet ejecting head in such a manner that vibration of liquid held in the at least one nozzle includes a component in the nozzle axis direction, wherein the vibration generating section mechanically vibrates an entirety of the droplet ejecting head without driving the actuator.

2. The droplet ejecting device according to claim 1, wherein the vibration generating section vibrates the droplet ejecting head to such an extent that a liquid droplet is held in the at least one nozzle of the droplet ejecting head without being ejected.

3. The droplet ejecting device according to claim 1, wherein the carriage comprises:

a sliding section that is configured to slide on the guide member when the moving section moves the carriage; and an engaging section provided in a non-contact manner from the guide member and capable of contacting the first protruding section.

4. The droplet ejecting device according to claim 1, wherein the vibration generating section comprises a second protruding section provided to the carriage and configured to protrude toward the guide member; and wherein the second protruding section is configured to be movable between a contact position at which the second protruding section contacts the guide member and a non-contact position at which the second protruding section is in non-contact with the guide member.

5. The droplet ejecting device according to claim 4, wherein the second protruding section is configured to adjust a protrusion amount, the protrusion amount being an amount by which the second protruding section protrudes from the carriage.

6. The droplet ejecting device according to claim 5, further comprising an ejection-frequency detecting section that detects ejection frequency of a liquid droplet from the at least one nozzle onto the ejection object, wherein the vibration generating section decreases the protrusion amount as the ejection frequency increases.

7. The droplet ejecting device according to claim 4, further comprising an ejection-frequency detecting section that detects ejection frequency of a liquid droplet from the at least one nozzle onto the ejection object, wherein, as the ejection frequency increases, the vibration generating section increases a time period from a time point when the second protruding section previously contacts the guide member to a time point when the second protruding section contacts the guide member next time.

8. The droplet ejecting device according to claim 4, wherein the carriage comprises a head holder that holds the droplet ejecting head;

wherein the vibration generating section further comprises a piezoelectric element and an urging member both supported by the head holder and connected to the second protruding section; and wherein the piezoelectric element and the urging member are configured to move the second protruding section between the contact position and the non-contact position.

9. The droplet ejecting device according to claim 1, wherein the carriage comprises a head holder that holds the droplet ejecting head;

wherein the vibration generating section comprises a second protruding section provided to the head holder in a non-fixed manner; and wherein the second protruding section is configured to be movable between a protruding position at which the second protruding section protrudes toward the droplet ejecting head and a non-protruding position at which the second protruding section is retracted, thereby directly vibrating the droplet ejecting head.

10. The droplet ejecting device according to claim 1, wherein the vibration generating section vibrates the droplet ejecting head when no liquid droplet is ejected from the at least one nozzle onto the ejection object for a predetermined time period.

11. The droplet ejecting device according to claim 1, wherein an ink droplet is ejected from the at least one nozzle onto a recording medium; and wherein the droplet ejecting device functions as an inkjet recording device.

12. A droplet ejecting device comprising:

a droplet ejecting head formed with at least one nozzle and configured to eject a liquid droplet through the at least one nozzle in a nozzle axis direction;

a carriage that supports the droplet ejecting head;

a guide member extending in a predetermined direction and configured to guide the carriage so that the carriage is movable in the predetermined direction;

a moving section that moves the carriage along the guide member, the droplet ejecting head being configured to eject a liquid droplet through the at least one nozzle onto an ejection object while the moving section moves the carriage; and a vibration generating section that vibrates the droplet ejecting head in such a manner that vibration of liquid held in the at least one nozzle includes a component in the nozzle axis direction, wherein the vibration generating section comprises a first protruding section provided to the guide member; and wherein the carriage is configured to contact the first protruding section while the moving section moves the carriage along the guide member, thereby generating vibration that vibrates the droplet ejecting head.

13. The droplet ejecting device according to claim 12, wherein the first protruding section is provided outside a range in which the carriage moves while the at least one nozzle is in confrontation with the ejection object.

14. The droplet ejecting device according to claim 12, wherein the first protruding section is configured to be movable between a first position at which the first protruding section is capable of contacting the carriage and a second position at which the first protruding section is incapable of contacting the carriage.

15. The droplet ejecting device according to claim 14, wherein the guide member has a guide surface on which the carriage moves; and wherein the first protruding section is configured to adjust a protrusion amount, the protrusion amount being an amount by which the first protruding section protrudes from the guide surface.

16. The droplet ejecting device according to claim 14, wherein the first protruding section comprises a plurality of first protruding sections arranged with an interval therebetween in the predetermined direction.

17. The droplet ejecting device according to claim 15, further comprising an ejection-frequency detecting section that detects ejection frequency of a liquid droplet from the at least one nozzle onto the ejection object, wherein the vibration generating section decreases the protrusion amount as the ejection frequency increases.

18. The droplet ejecting device according to claim 12, further comprising an ejection-frequency detecting section that detects ejection frequency of a liquid droplet from the at least one nozzle onto the ejection object, wherein, as the ejection frequency increases, the vibration generating section increases a time period from a time point when the carriage previously contacts the first protruding section to a time point when the carriage contacts the first protruding section next time.

19. A droplet ejecting device comprising:

a droplet ejecting head formed with at least one nozzle and configured to eject a liquid droplet through the at least one nozzle in a nozzle axis direction;

a carriage that supports the droplet ejecting head;

a guide member extending in a predetermined direction and configured to guide the carriage so that the carriage is movable in the predetermined direction;

a moving section that moves the carriage along the guide member, the droplet ejecting head being configured to eject a liquid droplet through the at least one nozzle onto an ejection object while the moving section moves the carriage; and a vibration generating section that vibrates the droplet ejecting head in such a manner that vibration of liquid held in the at least one nozzle includes a component in the nozzle axis direction, wherein the vibration generating section comprises a first protruding section provided in a first range in which the carriage is movable when viewed from a gravitational direction; and wherein the carriage is configured to contact the first protruding section while the moving section moves the carriage along the guide member, thereby generating vibration that vibrates the droplet ejecting head.

* * * * *